US008757778B2

(12) United States Patent
Fricke et al.

(10) Patent No.: US 8,757,778 B2
(45) Date of Patent: Jun. 24, 2014

(54) THERMAL INK-JETTING RESISTOR CIRCUITS

(75) Inventors: Peter Fricke, Corvallis, OR (US); Mark Hunter, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 53 days.

(21) Appl. No.: 13/460,322

(22) Filed: Apr. 30, 2012

(65) Prior Publication Data

US 2013/0286103 A1 Oct. 31, 2013

(51) Int. Cl.
*B41J 2/05* (2006.01)

(52) U.S. Cl.
USPC ..... 347/58

(58) Field of Classification Search
None
See application file for complete search history.

(56) References Cited

U.S. PATENT DOCUMENTS

| | | | | |
|---|---|---|---|---|
| 5,890,819 | A | 4/1999 | Compton | |
| 6,439,678 | B1 | 8/2002 | Norton | |
| 6,476,928 | B1 | 11/2002 | Barbour et al. | |
| 6,547,353 | B2 * | 4/2003 | Hopkins | 347/12 |
| 6,976,752 | B2 | 12/2005 | Parish et al. | |
| 7,513,588 | B2 | 4/2009 | Huang | |
| 2009/0040277 | A1 | 2/2009 | Han et al. | |

OTHER PUBLICATIONS

Roncaglia, et al. Driver Design Optimization in InkJet Printing Technology, 2012.

* cited by examiner

*Primary Examiner* — Geoffrey Mruk

(57) ABSTRACT

Electronic circuitry compensates for variations or sags in electrical voltage within a thermal ink-jetting (TIJ) printing apparatus. Ground potential and other supply-related voltages are monitored and corresponding signals are provided. The signals are used, directly or by other circuitry, to affect the biasing of one or more transistors coupling TIJ resistors to supply voltage or ground nodes. Printing errors and related problems associated with voltage variations are reduced or eliminated accordingly.

8 Claims, 9 Drawing Sheets

THERMAL INK-JETTING RESISTOR CIRCUITS

BACKGROUND

Thermal ink-jet printers form images on media by controlled ejection of ink from a printhead. A resistor is electrically energized so as to rapidly boil ink within a firing chamber and a quantity of the ink is then ejected through a nozzle. A printhead typically includes numerous firing chambers and a corresponding number of thermal ink-jetting (TIJ) resistors.

As the number of TIJ resistors within a printhead increases, or as they are fired with increasing frequency toward greater printing speeds, the electrical power required increases accordingly. Supply voltage levels tend to vary or sag with increasing power demands resulting in printing errors, inconsistencies or other imaging problems. The present teachings address the foregoing and related concerns.

BRIEF DESCRIPTION OF THE DRAWINGS

The present embodiments will now be described, by way of example, with reference to the accompanying drawings, in which.

DETAILED DESCRIPTION

Introduction

Electronic circuitry compensates for variations or sags (i.e., dips, or decreases) in electrical voltage within a thermal ink-jetting (TIJ) printing apparatus. Ground potential and other supply-related voltages are monitored and corresponding signals are provided. The signals are used, directly or by other circuitry, so as to affect the biasing of one or more transistors that respectively couple TIJ resistors to supply voltage or ground nodes. Printing errors, undesirable artifacts, and related problems associated with voltage variations are reduced or eliminated accordingly.

In one example, an electronic circuit includes at least one of a level shifter or a ground follower. The level shifter is configured to receive a signal corresponding to a voltage difference between a power node and a ground node. The level shifter is also configured to bias a first transistor in accordance with the signal, the first transistor being configured to electrically couple a thermal ink-jetting (TIJ) resistor to the ground node. The ground follower is coupled to a biasing node and to the ground node. The ground follower is configured to adjust a biasing voltage to a second transistor in accordance with a voltage difference between the biasing node and the ground node. The second transistor is configured to electrically couple the TIJ resistor to the power node.

In another example, a method is performed using electronic circuitry. The method includes deriving a signal corresponding to a voltage at a power node. The method also includes biasing a first transistor in accordance with the signal, the first transistor configured to electrically couple a thermal ink-jetting (TIJ) resistor to a ground node. The method further includes biasing a second transistor in accordance with a voltage difference between a biasing node and the ground node, the second transistor being configured to electrically couple the TIJ resistor to the power node.

First Illustrative TIJ Driver Circuit

Figure 1:
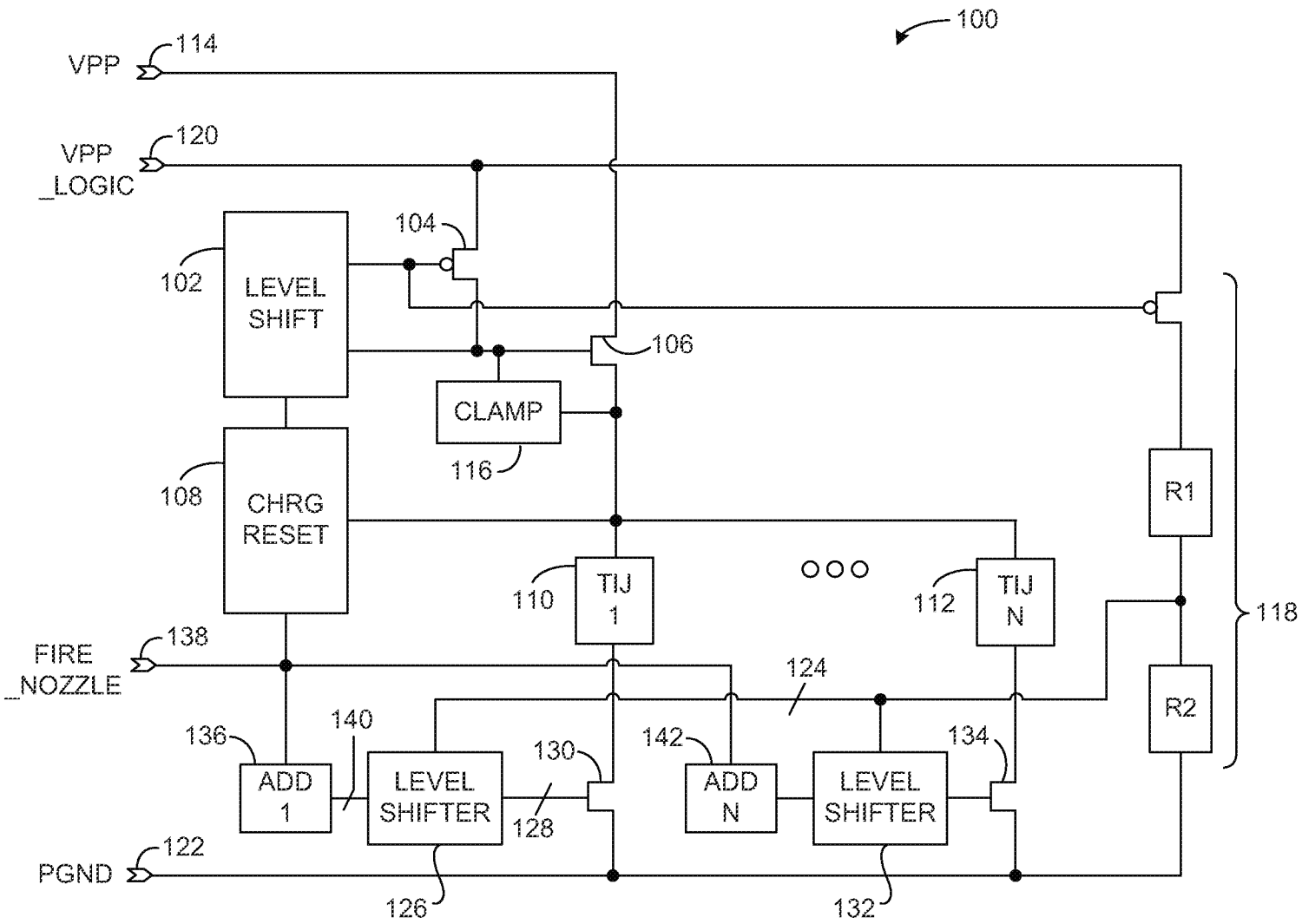
FIG. 1 depicts a schematic view of a thermal ink-jetting driver circuit according to one example of the present teachings.

Attention is now turned to FIG. 1, which depicts a thermal ink-jetting (TIJ) driver circuit (circuit) 100 according to the present teachings. The circuit 100 is illustrative and non-limiting with respect to the present teachings. Other circuits, devices, printheads and apparatus having other respective characteristics can also be defined and used. In at least one example, the circuit 100 defines a portion of an inkjet printing system.

The circuit 100 includes level shifting circuitry 102 configured to provide biasing signals to respective transistors (i.e., switches) 104 and 106 of the circuit 100. The circuit 100 also includes charge reset circuitry 108 configured to monitor voltages applied to respective thermal ink-jetting (TIJ) resistors 110 and 112 of the circuit 100 and to provide feedback (or corrective) signaling to the level shifting circuitry 102. One having ordinary skill in the TIJ printing or related arts is familiar with level shifting circuitry and charge reset circuitry, or their respective analogs, and further description is not needed for purposes of the present teachings.

The transistor 106 is configured to electrically couple the TIJ resistor 110 and the TIJ resistor 112 to a supply of voltage present at a power node 114 in accordance with biasing signals provided by the level shifting circuitry 102. The circuit 100 also includes clamp circuitry 116 configured to prevent over-biasing or over-voltage related damage to the transistor 106. One having ordinary skill in the art is also familiar with clamp circuitry or the like and further description is not needed for purposes of the present teachings.

The circuit 100 also includes local regulator circuitry (regulator) 118 in accordance with the present teachings. The regulator 118 is configured to track a voltage difference between a logic voltage node 120 and a ground node 122 and to provide a signal 124 corresponding to the voltage difference. Illustrative and non-limiting circuitry for such a regulator 118 is described hereinafter.

The circuit 100 also includes level shifter circuitry (level shifter) 126 in accordance with the present teachings. The level shifter 126 is configured to receive the signal 124 from the regulator 118 and to provide a biasing signal 128 to a transistor (i.e., switch) 130 accordingly. Illustrative and non-limiting circuitry for such a level shifter 126 is described hereinafter. The transistor 130 is configured to couple the TIJ resistor 110 to ground potential at the ground node 122 in accordance with the biasing signal 128.

The circuit 100 also includes level shifter circuitry (level shifter) 132 in accordance with the present teachings. The level shifter 132 is essentially equivalent to the level shifter 126, and is configured to receive the signal 124 from the regulator 118 and to provide a biasing signal to a transistor (i.e., switch) 134 accordingly. The transistor 134 is configured to couple the TIJ resistor 112 to ground potential at the ground node 122 in accordance with the biasing signal provided by the level shifter 132.

The circuit 100 also includes address decoder circuitry (ADD) 136. The ADD 136 is configured to receive and decode nozzle address and nozzle firing signals provided at a fire node 138. The ADD 136 then provides an asserted fire signal 140 to the level shifter 126 in response to an asserted signal addressed to the TIJ resistor 110. The level shifter 126 responds to the asserted signal 140 by biasing the transistor 130 into conduction (i.e., "on") for a brief, pulse-like period of time (e.g., 1-10 microseconds). One having ordinary skill in the art is familiar with address decoder circuitry or the like and further description is not needed for purposes of the present teachings.

The circuit 100 further includes address decoder circuitry (ADD) 142. The ADD 142 receives and decodes nozzle address and nozzle fire signaling at the fire node 138, and provides an asserted signal to the level shifter 132 accordingly. The level shifter 132 responds to the asserted signal by biasing the transistor 134 into conduction.

The circuit 100 is depicted as including two TIJ resistors 110 and 112 and associated circuitry resources 126, 130, 132, 134, 136 and 142, respectively, in the interest of clarity. Thus, as depicted, "N"=2. However, the present teachings contemplate circuits, printheads or printing apparatus having any suitable number of TIJ resistors (e.g., eight, sixteen, and so on) and corresponding circuitry. Thus, the two TIJ resistors 110 and 112 (and their associated circuitry) are illustrative and non-limiting.

Typical normal operation of the circuit 100 is generally as follows: source voltage, logic-level voltage and ground potential are provided at the nodes 114, 120 and 122, respectively, by way of resources not particular to the present teachings. Encoded address and firing signals are provided at the node 138 such that the respective TIJ resistors 110 and 112 are fired, resulting in the formation of images on media. Such images correspond to the content of an electronic file for a text document, photograph, or other suitable object. The image formation process is generally referred to as printing.

Electrical power consumption varies with printing speed, image density or other factors such that the voltage levels present at the power node 114 or the ground node 122 can vary. In one specific example, an increase in electrical current flow along a ground buss and the corresponding resistive voltage drop (i.e., parasitic loss) can result in a voltage increase away from a baseline zero level at the ground node 122. Such a voltage rise results in a decrease in the voltage difference between the power node 114 and the ground node 122, and a corresponding loss of available power for firing the respective TIJ resistors 110 and 112. Imaging errors or other printing problems can result.

However, in accordance with the present teachings, the regulator 118 tracks the voltage difference between the logic voltage node 120 and the ground node 122 and provides a corresponding signal 124 to the level shifters 126 and 132, respectively. The level shifters 126 and 132 compensate for decreases (i.e., dips, or sags) in the detected voltage difference by varying the biasing on the transistors 130 and 134, respectively.

Specifically, when the ground voltage level at node 122 increases, then the node 128 correspondingly increases to maintain a constant gate-to-source voltage for the device 130, thus maintaining the electrical conduction level of device 130. Normal printing operations can therefore be performed at various speeds or intensities with little or no adverse effects resulting from source voltage drops or fluctuations.

Second Illustrative TIJ Driver Circuitry

Figure 2:
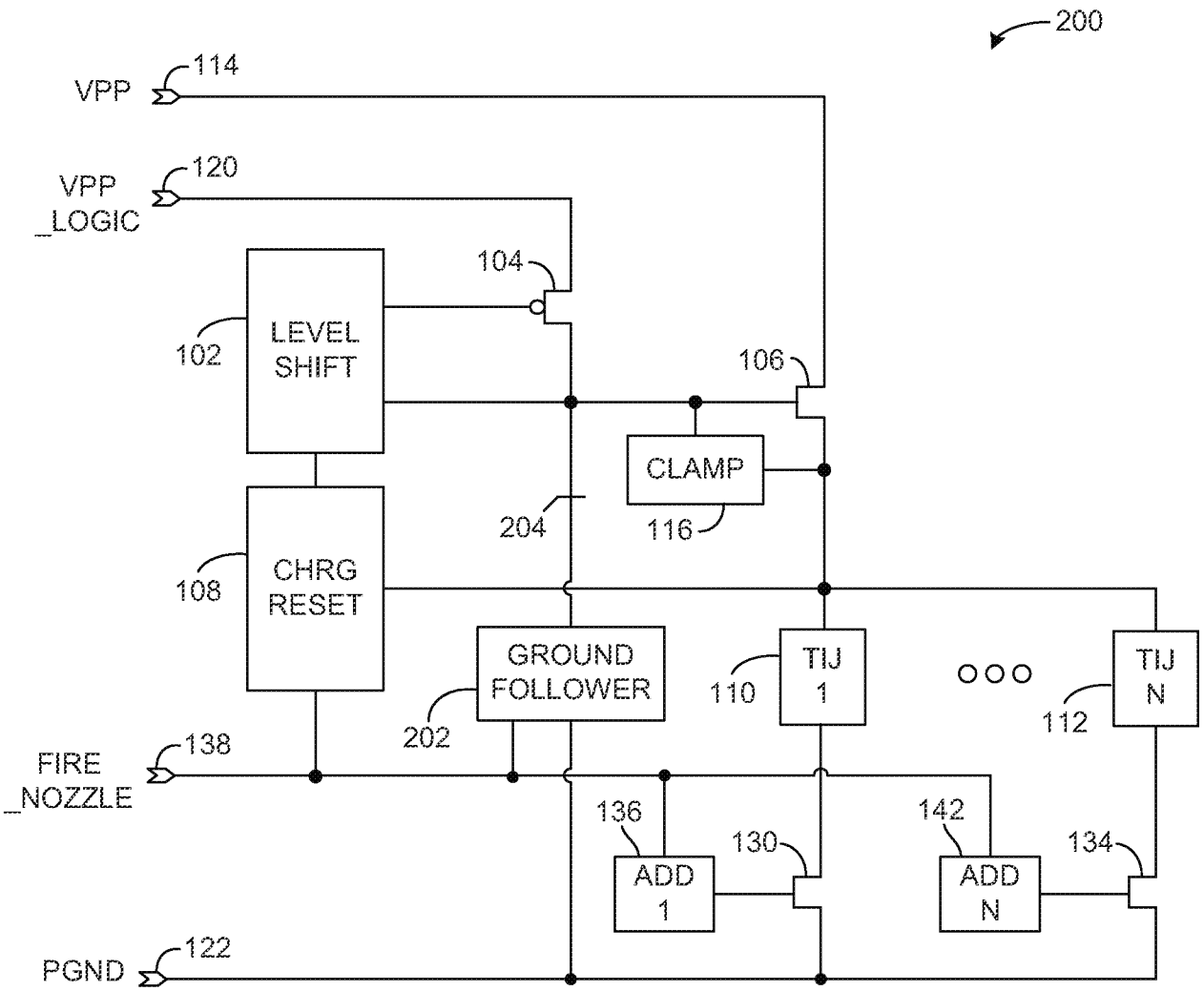
FIG. 2 depicts a schematic view of another thermal ink-jetting driver circuit in accordance with the present teachings.

Attention is now turned to FIG. 2, which depicts a thermal ink-jetting (TIJ) driver circuit (circuit) 200 according to the present teachings. The circuit 200 is illustrative and non-limiting with respect to the present teachings. Other circuits, devices, printheads and apparatus having other respective characteristics can also be defined and used. In at least one example, the circuit 200 defines a portion of an inkjet printing system.

The circuit 200 includes the elements 102, 104, 106, 108, 110, 112, 116, 130, 134, 136, and 142, respectively, being defined, configured and operative as described above, and as respectively described further below. The circuit 200 also includes ground follower circuitry (ground follower) 202. Illustrative and non-limiting circuitry for such a ground follower 202 is described hereinafter. The ground follower 202 is coupled to the ground node 122 and to the fire node 138. The ground follower 202 is configured to provide a signal 204 that is coupled to the transistor 106.

The ground follower 202 operates to monitor the voltage at the ground node 122 and to affect the biasing of the transistor 106 during TIJ resistor (110 or 112, and so on) operation. In particular, the ground follower 202 provides a signal 204 that controls the transistor 106 by increasing the gate voltage in response to a rise in ground potential at the node 122 away from the baseline zero level. In turn, the voltage at the source of the transistor 106 follows the gate voltage, thus maintaining a constant voltage across TIJ resistor 110. The ground follower 202 therefore compensates for ground voltage rise during times of relatively greater electrical power demand.

Third Illustrative TIJ Driver Circuitry

Figure 3:
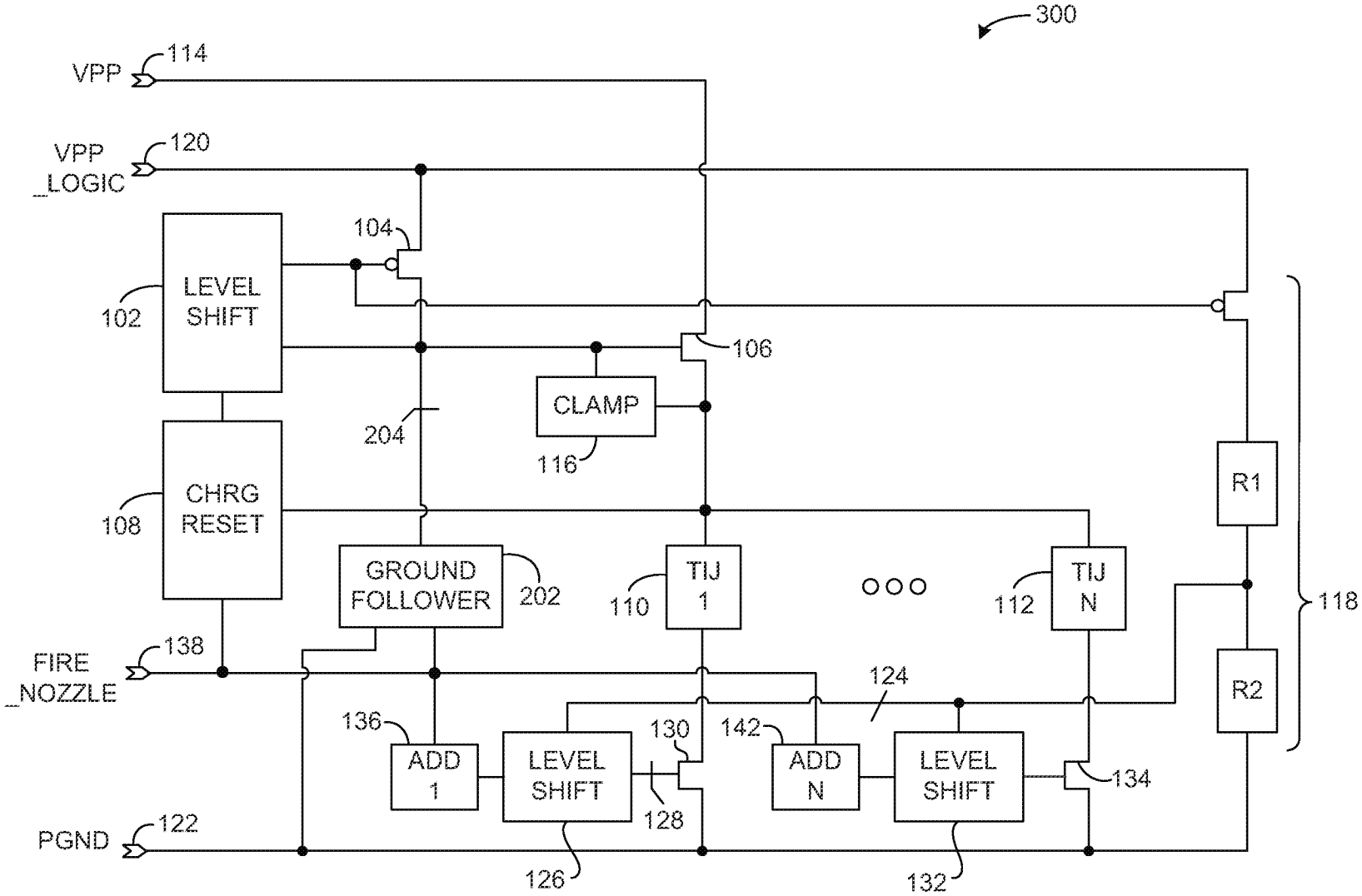
FIG. 3 depicts a schematic view of another thermal ink-jetting driver circuit in accordance with the present teachings.

Reference is made now to FIG. 3, which depicts a thermal ink-jetting (TIJ) driver circuit (circuit) 300 according to the present teachings. The circuit 300 is illustrative and non-limiting with respect to the present teachings. Other circuits, devices, printheads and apparatus having other respective characteristics can also be defined and used. In at least one example, the circuit 300 defines a portion of an inkjet printing system.

The circuit 300 includes the elements 102, 104, 106, 108, 110, 112, 116, 118, 126, 130, 132, 134, 136, 142 and 202, respectively, being defined, configured and operative as described above, and as respectively described further below. The circuit 300 therefore includes level shifters 126 and 132, and a ground follower 202, that respectively operate as described above.

For non-limiting example, the transistor 130 is biased by the level shifter 126, while biasing of the transistor 106 is affected by the ground follower 202, during operation of the TIJ resistor 110. This is done so as to compensate for variations or decreases in the supply voltage difference between the power node 114 and the ground node 122. Analogous operation of the TIJ resistor 112 is also performed by way of the level shifter 132 and the ground follower 202.

Fourth Illustrative TIJ Driver Circuitry

Figure 4:
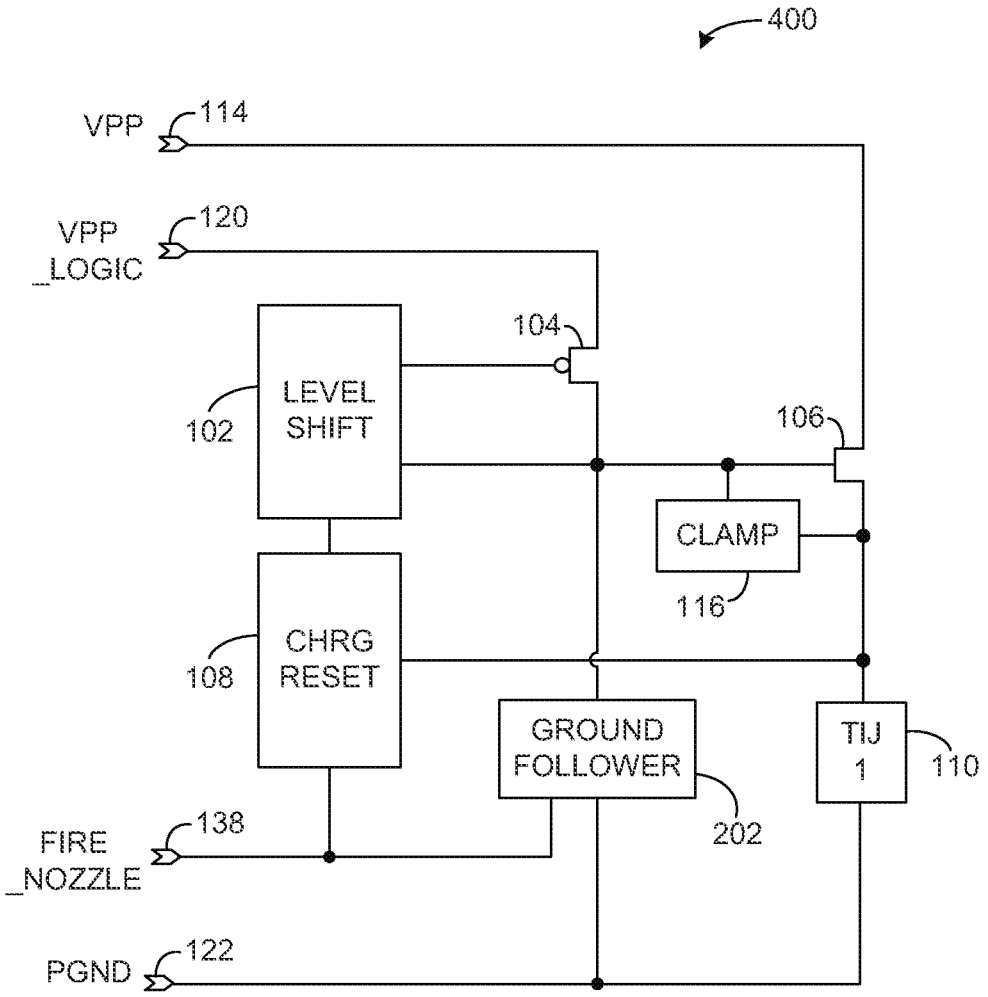
FIG. 4 depicts a schematic view of still another thermal ink-jetting driver circuit in accordance with the present teachings.

Attention is directed to FIG. 4, which depicts a thermal ink-jetting (TIJ) driver circuit (circuit) 400 according to the present teachings. The circuit 400 is illustrative and non-limiting with respect to the present teachings. Other circuits, devices, printheads and apparatus having other respective characteristics can also be defined and used. In at least one example, the circuit 400 defines a portion of an inkjet printing system.

The circuit 400 includes the elements 102, 104, 106, 108, 110, 116, and 202, respectively, being defined, configured and operative as described above, and as respectively described further below. The circuit 400 includes a ground follower 202 that operates as described above. The TIJ resistor 110 is connected directly to the ground node 122. For non-limiting example, the transistor 106 biasing is affected by the ground follower 202 so as to compensate for variations or decreases in the supply voltage difference between the power node 114 and the ground node 122.

No address decoder circuitry (ADD) is present, because only the single TIJ resistor 110 is present. That is, address decoding is incorporated into the relatively simpler trigger signaling at the fire node 138, and such suffices for normal operation. The circuit 400 thus depicts a simplified example that does not use a matrix of plural TIJ resistors or the corresponding signal decoding.

Fifth Illustrative TIJ Driver Circuitry

Figure 5:
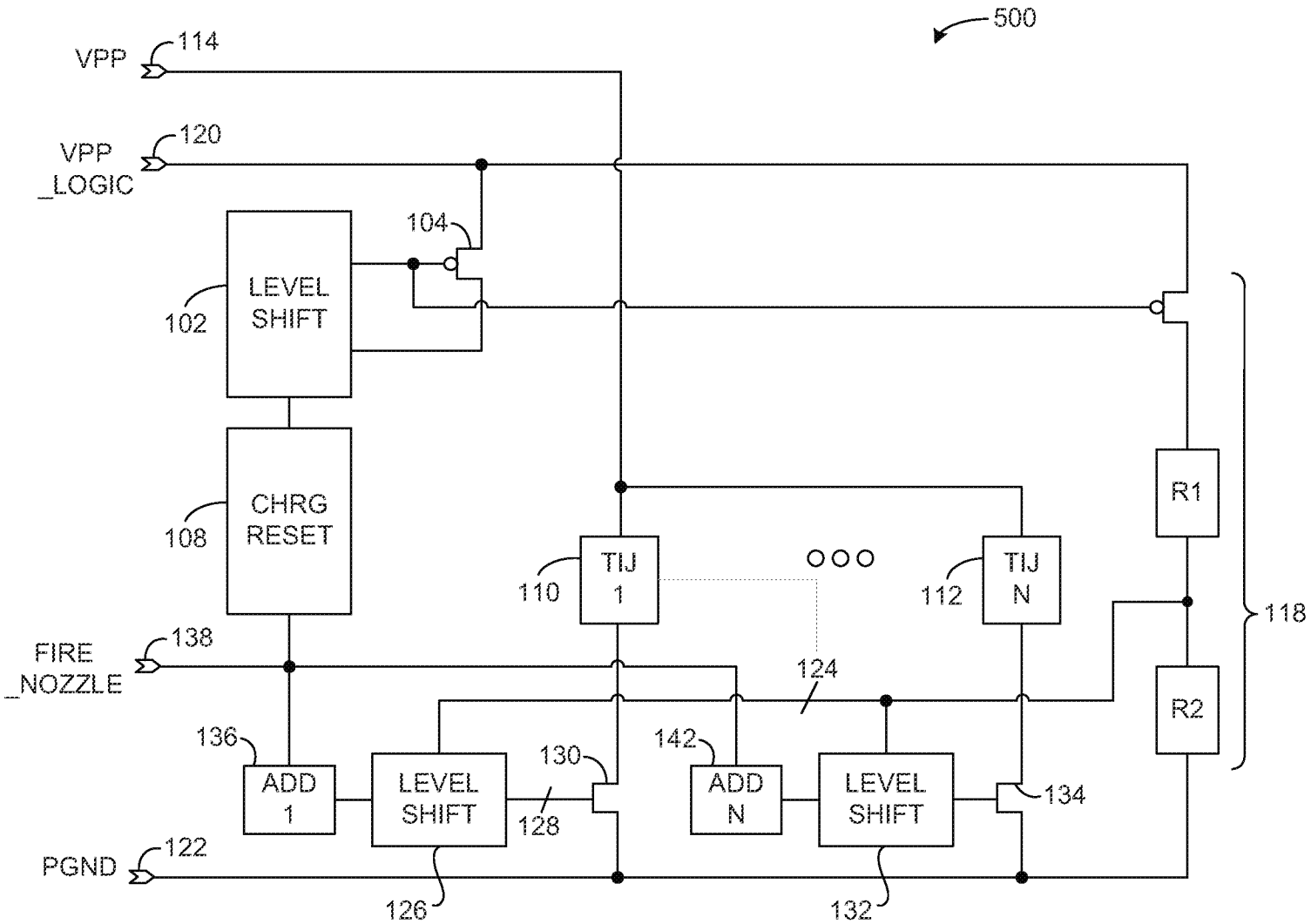
FIG. 5 depicts a schematic view of another thermal ink-jetting driver circuit in accordance with the present teachings.

Attention is directed to FIG. 5, which depicts a thermal ink-jetting (TIJ) driver circuit (circuit) 500 according to the present teachings. The circuit 500 is illustrative and non-limiting with respect to the present teachings. Other circuits, devices, printheads and apparatus having other respective characteristics can also be defined and used. In at least one example, the circuit 500 defines a portion of an inkjet printing system.

The circuit 500 includes the elements 102, 104, 108, 110, 112, 118, 126, 130, 132, 134, 136, and 142, respectively, being defined, configured and operative as described above, and as respectively described further below. The circuit 500 therefore includes a regulator 118 and respective level shifters 126 and 132 that operate as respectively described above.

For non-limiting example, the transistor 130 is biased by the level shifter 126, while transistor 134 biased by the level shifter 132. The respective TIJ resistors 110 and 112 are directly connected to a source of voltage at the power node 114. The level shifter 126 is configured to receive the signal 124 from the regulator 118 and to provide a biasing signal 128 to the transistor (i.e., switch) 130 accordingly.

Analogous operation of the TIJ resistor 112 is also performed by way of the level shifter 132 and the regulator 118. The regulator 118 and the respective level shifters 126 and 132 operate so as to compensate for variations or decreases in the supply voltage difference between the logic voltage node 120 and the ground node 122.

Sixth Illustrative TIJ Driver Circuitry

Figure 6:
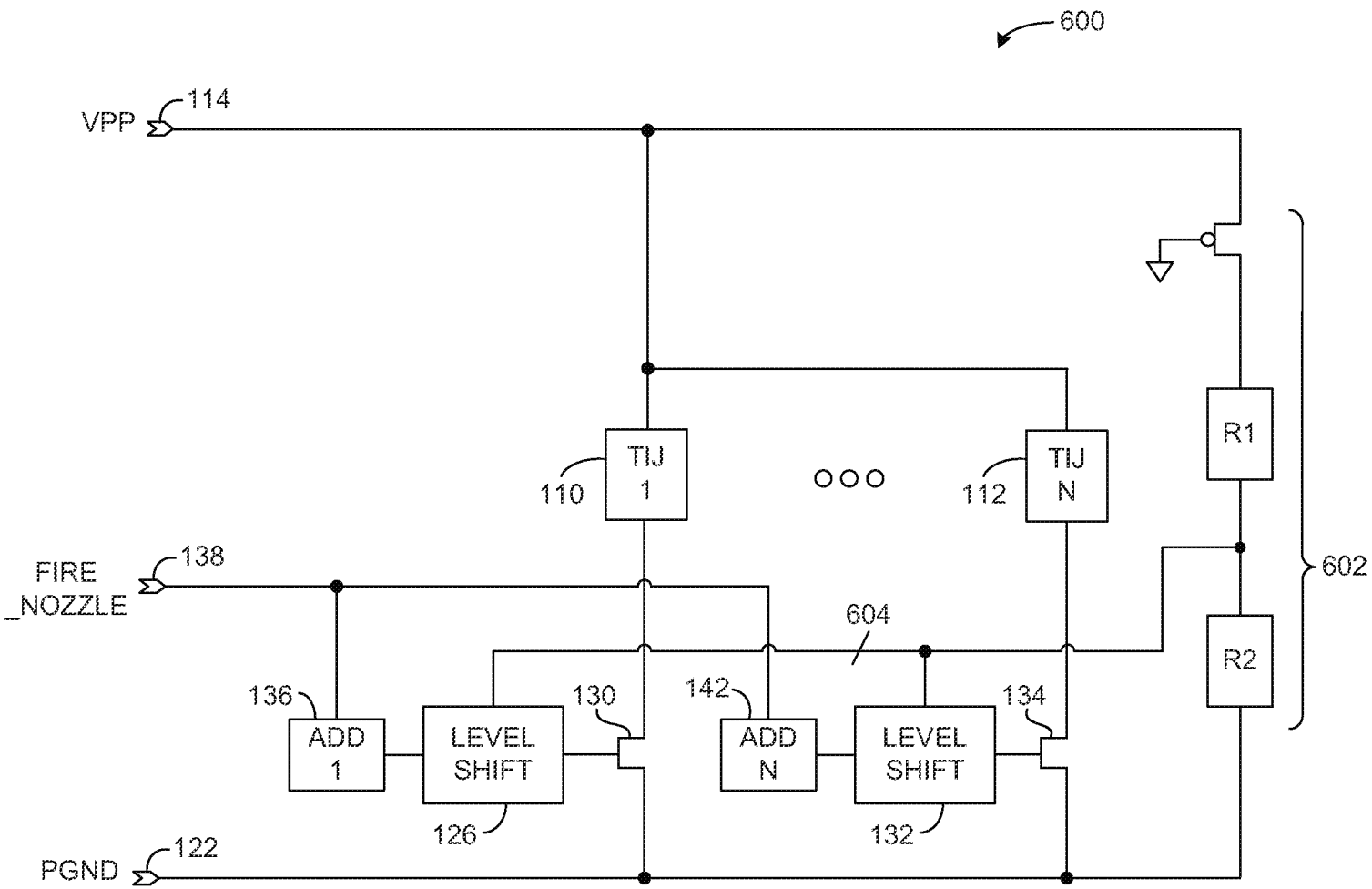
FIG. 6 depicts a schematic view of another thermal ink-jetting driver circuit in accordance with the present teachings.

Attention is directed to FIG. 6, which depicts a thermal ink-jetting (TIJ) driver circuit (circuit) 600 according to the present teachings. The circuit 600 is illustrative and non-limiting with respect to the present teachings. Other circuits, devices, printheads and apparatus having other respective characteristics can also be defined and used. In at least one example, the circuit 600 defines a portion of an inkjet printing system.

The circuit 600 includes the elements 110, 112, 126, 130, 132, 134, 136, and 142, respectively, being defined, configured and operative as described above, and as respectively described further below. The circuit 600 also includes a regulator 602. The regulator 602 is configured to track a voltage difference between the power node 114 and the ground node 122, and to provide a signal 604 corresponding to the voltage difference. The regulator 602 is generally analogous to the regulator 118, but tracks a voltage difference by way of the power node 114 rather than a logic voltage node 120.

For non-limiting example, the transistor 130 is biased by the level shifter 126, while transistor 134 biased by the level shifter 132. The respective TIJ resistors 110 and 112 are directly connected to a source of voltage at the power node 114. The level shifter 126 is configured to receive the signal 604 from the regulator 602 and to provide a biasing signal to the transistor (i.e., switch) 130 accordingly.

Figure 7:
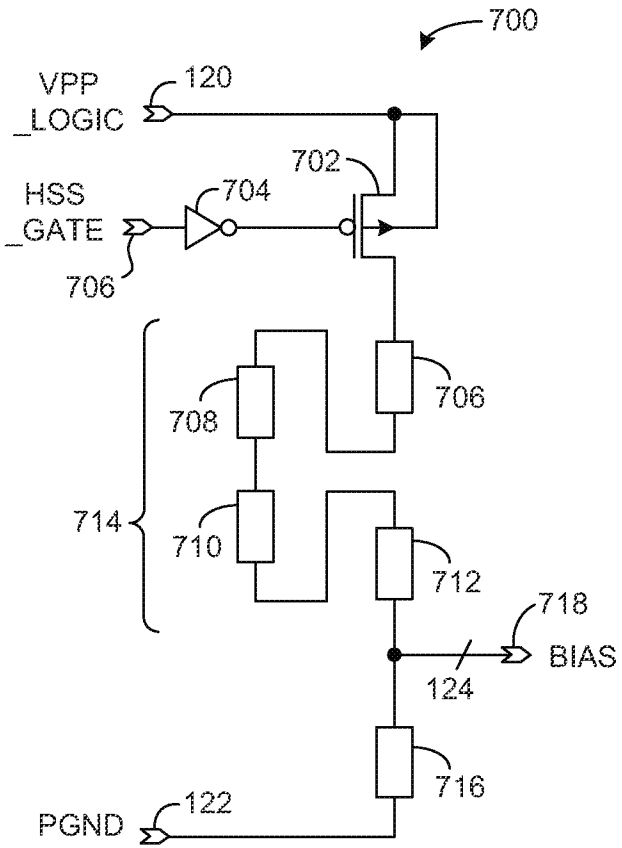
FIG. 7 depicts a schematic view of a regulator circuit in accordance with the present teachings.

Analogous operation of the TIJ resistor 112 is also performed by way of the level shifter 132 and the regulator 602. The regulator 602 and the respective level shifters 126 and 132 operate so as to compensate for variations or decreases in the supply voltage difference between the power node 114 and the ground node 122, Illustrative Regulator Circuitry Attention is turned now to FIG. 7, which depicts a regulator circuit (regulator) 700 according to one example of the present teachings. The regulator 700 is illustrative and non-limiting in nature, and the present teachings contemplate that other regulator circuits can be used. In one or more examples, the regulator 118 is essentially equivalent to the regulator 700.

The regulator 700 includes a transistor 702. In one example, the transistor 702 is defined by a high-voltage P-type metal oxide semiconductor (HVPMOS) device. Other suitable transistors can also be used. The transistor 702 is configured to be coupled to the logic voltage node 120. The regulator 700 also includes a logic inverter 704 coupling the transistor 702 to a high-side gate (HSG) node 706. In one example, the HSG node 706 carries a biasing signal provided by a level shifting circuitry 102. Other suitable signals or sources can also be used.

The regulator 700 also includes respective resistors 706, 708, 710 and 712, coupled in series-circuit arrangement, collectively defining a resistance 714. In one example, the individual resistors 706-712 can be selected so as to define a resistance 714 of twenty-four thousand Ohms. Other suitable resistors can also be used. The regulator 700 also includes a resistor 716 that is configured to couple the regulator 700 to the ground node 122.

The regulator 700 is configured to provide a bias signal 124 at a node 718 corresponding to the voltage difference between the logic voltage node 120 and the ground node 122. The bias signal 124 is received by level shifters (e.g., 126, 132 and so on) according the present teachings and as described herein.

Illustrative Level Shifter Circuitry

Figure 8:
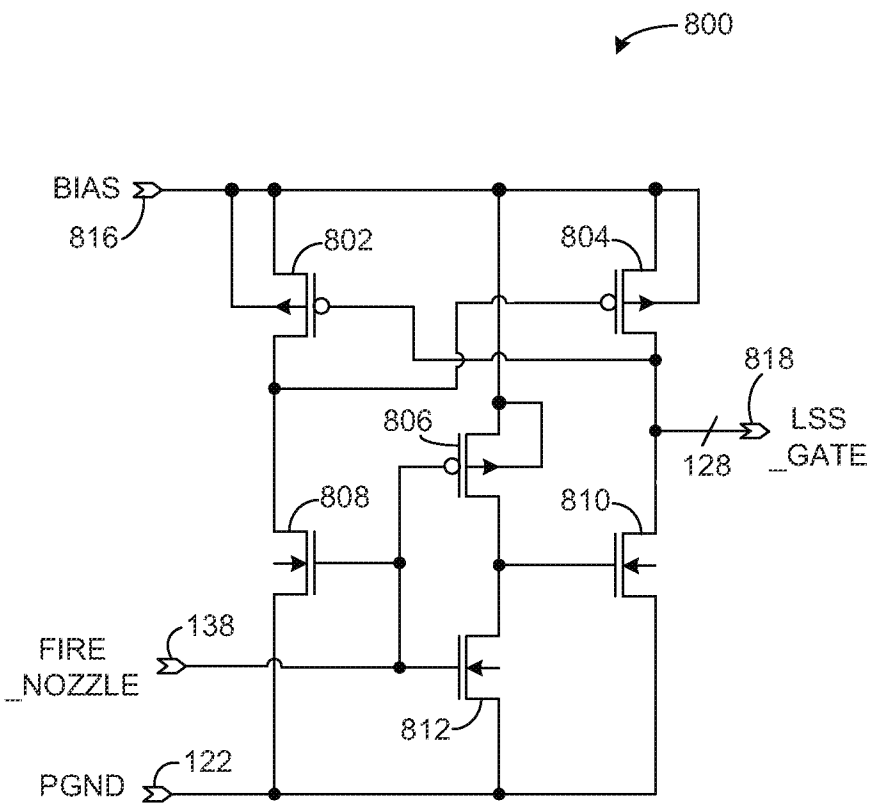
FIG. 8 depicts a schematic view of a level shifter circuit in accordance with the present teachings.

Attention is turned now to FIG. 8, which depicts a level shifter circuit (level shifter) 800 according to one example of the present teachings. The level shifter 800 is illustrative and non-limiting in nature, and the present teachings contemplate that other level shifter circuits can be used. In one or more examples, the respective level shifters 126 and 132 are essentially equivalent to the level shifter 800.

The level shifter 800 includes respective transistors 802, 804, 806, 808, 810 and 812, coupled and configured as shown. In one example, the transistors 802, 804 and 806 are each defined by a P-type MOS (pmos) device, while the transistors 808, 810 and 812 are each defined by an N-type MOS (nmos) device. Other respectively suitable transistors can also be used. The level shifter 800 is configured to be coupled to the fire node 138, and to the ground node 122. The level shifter 800 is also configured to be coupled to a biasing signal at a node 816. Such a biasing signal at the node 816 can be provided, for non-limiting example, by the regulator 700 (e.g., node 718).

The level shifter 800 is further configured to provide a low-side gate (LSG) biasing signal 128 at a node 818. The biasing signal 128 is characterized so as to bias a transistor (e.g., 130) into conduction in order to couple a corresponding TIJ resistor (e.g., 110) to ground potential during normal firing operations thereof.

Illustrative Ground Follower Circuitry

Figure 9:
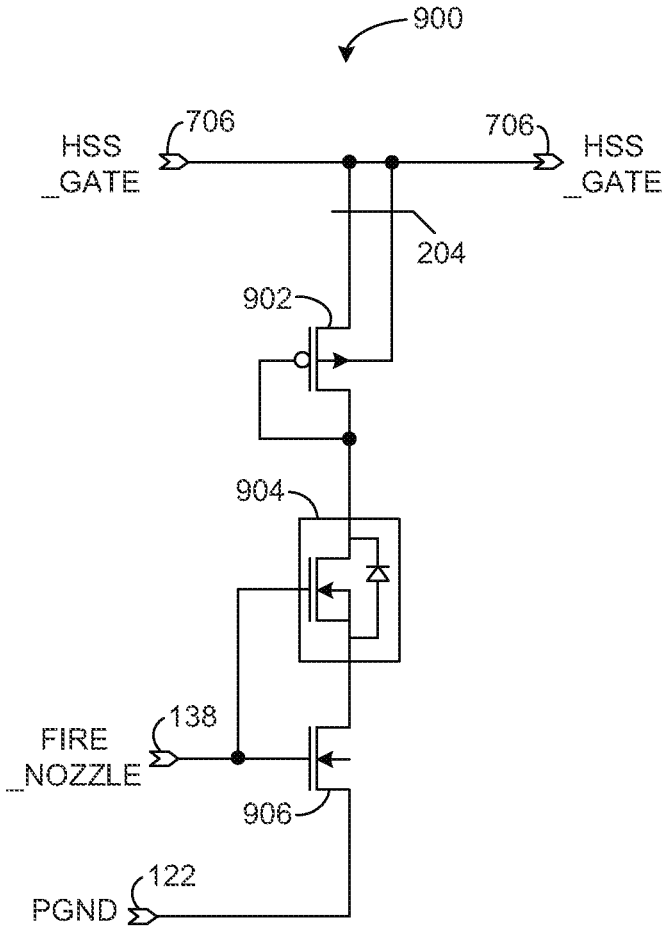
FIG. 9 depicts a schematic view of a ground follower circuit in accordance with the present teachings.

Attention is turned now to FIG. 9, which depicts a ground follower circuit (ground follower) 900 according to one example of the present teachings. The ground follower 900 is illustrative and non-limiting in nature, and the present teachings contemplate that other ground follower circuits can be used. In one or more examples, the ground follower 202 is essentially equivalent to the ground follower 900.

The ground follower 900 includes a transistor 902. In one example, the transistor 902 is defined by a HVPMOS device. The ground follower 900 also includes a transistor 904. In one example, the transistor 904 is defined by a laterally diffused MOS (LDMOS) device. The ground follower 900 further includes a transistor 906. In one example, the transistor 906 is defined by an nmos device. Other respectively suitable transistors can also be used.

The ground follower 900 is configured to be coupled to the HSG biasing signal at the node 706, and to the fire node 138, and to the ground node 122. The ground follower 900 is configured to provide a signal 204 that affects or adjusts (i.e., increases or reduces) the HSG biasing signal at the node 706.

In particular, the ground follower 900 monitors the voltage at the ground node 122 and provides the signal 204 by increasing the gate voltage of a transistor (e.g., 106) during firing of a TIJ resistor (e.g., 110 or 112, and so on). The magnitude of the ground follower 900 signal 204 corresponds to a rise in ground potential at the node 122 away from the baseline zero level.

Illustrative Printing Apparatus

Figure 10:
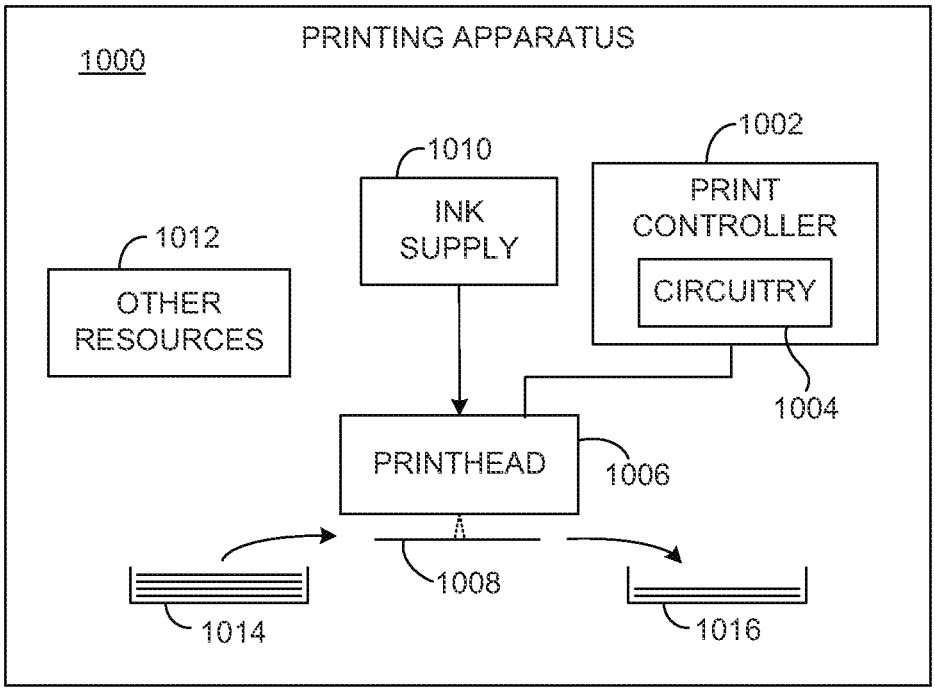
FIG. 10 depicts a block diagram of a printing apparatus according to another example of the present teachings.

Attention is turned now to FIG. 10, which depicts a block diagram of a printing apparatus (printer) 1000. The printer 1000 is illustrative and non-limiting with respect to the present teachings. Other printers, apparatus or devices of respectively varying configurations or resources can also be used.

The printer 1000 includes a print controller 1002 configured to control various normal operations of the printer 1000. The print controller 1002 can be defined by or include a processor configured to operate in accordance with a machine-readable program code, an ASIC, a state machine, and so on. Other constituency can also be used.

The print controller 1002 includes circuitry 1004, having one or more resources in accordance with the present teachings. In one example, the circuitry 1004 includes or is defined by the TIJ driver circuit 100 as described above. In another example, the circuitry 1004 includes or is defined by the TIJ driver circuit 200 as described above. In yet another example, the circuitry 1004 includes or is defined by the TIJ driver circuit 300 as described above. Other TIJ driver circuits or resources according to the present teachings can also be used. The print controller 1002 thus includes circuitry of the present teachings directed to compensating for variations in electrical voltage that can occur during normal printing operations.

The printer 1000 also includes a printhead 1006. The printhead 1006 is configured to form images on sheet media 1008 in accordance with electronic signaling provided by the print controller 1002. The printhead 1006 includes one or more TIJ resistors (e.g., 110, 112, and so on) configured to function in accordance with the present teachings. Thus, the printhead 1006 can be operated such that an ink or inks can be ejected from the respective firing chambers so as to perform normal printing upon sheet media 1008.

The printer 1000 also includes an ink supply 1010. The ink supply 1010 is configured to provide one or more colors of printing ink to the printhead 1006 by way of fluid coupling there between. In one example, the ink supply 1010 is distinct from the printhead 1006. In another example, the ink supply 1010 is at least partially integrated with the printhead 1006. Other suitable configurations can also be used.

The printer 1000 further includes other resources 1012. The other resources 1012 can be defined by any suitable constituency including, without limitation, a power supply, a user interface, a display screen, network communications circuitry, wireless communications circuitry, computer-accessible data storage, media handling or transport mechanisms, and so on. Other constituents can also be used. One having ordinary skill in the printer or related arts can appreciate that various resources can be incorporated within varying embodiments of printers, and further elaboration is not required for purposes of the present teachings.

Typical, normal operation of the printer 1000 is as follows: a data file corresponding to images to be printed onto media is received by the print controller 1002 from an external entity (e.g., a computer). The print controller 1002 provides electronic signaling to the printhead 1006 so as to form the images onto sheet media 1008. Successive sheets of media 1008 are drawn from a supply 1014, images are formed thereon, and then the sheets of media 1008 are accumulated within a receiver 1014.

Intensity of the printing operations can vary during normal use of the printer 1000, resulting in supply voltage variations that are communicated to the TIJ resistors (e.g., 110, 112). Such variations—typically in the form of sags or reductions in available voltage (power)—can otherwise result in printing errors, imaging problems and so on. However, circuitry 1004 of the present teachings operates to compensate for such voltage variations, thus reducing or preventing such voltage-related problems.

Therefore, the present teachings contemplate any number of examples in which electronic circuitry operates to compensate for voltage fluctuations that would otherwise occur due to changes in printer operating intensity. Additionally, such compensation means that the physical size (i.e., cross-sectional area) of respective electrical traces (i.e., busses, or conductive pathways) carrying electrical power to the TIJ resistors can be reduced accordingly. Reduced die size and reduced cost of production are desirable results.

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. An electronic circuit, comprising at least one of:

a level shifter configured to receive a signal corresponding to a voltage difference between a power node and a ground node, the level shifter configured to bias a first transistor in accordance with the signal, the first transistor configured to electrically couple a thermal ink-jetting (TIJ) resistor to the ground node; or a ground follower coupled to a biasing node and to the ground node, the ground follower configured to adjust a biasing voltage to a second transistor in accordance with a voltage difference between the biasing node and the ground node, the second transistor configured to electrically couple the TIJ resistor to the power node.

2. The electronic circuit according to claim 1 further comprising regulator circuitry configured to provide the signal to the level shifter, the regulator circuitry including a voltage divider coupled between a logic voltage node and the ground node by way of a third transistor.

3. The electronic circuit according to claim 1 further comprising the TIJ resistor.

4. The electronic circuit according to claim 1, wherein the level shifter defined at least in part by an application specific integrated circuit (ASIC).

5. The electronic circuit according to claim 1, wherein the ground follower defined at least in part by an application specific integrated circuit (ASIC).

6. The electronic circuit according to claim 1, wherein the level shifter further configured to operate in accordance with a nozzle firing signal.

7. The electronic circuit according to claim 1, wherein the level shifter including circuitry configured to define a flip-flop.

8. The electronic circuit according to claim 1, wherein the electronic circuit being a portion of a TIJ printing apparatus.

* * * * *